US005918720A

United States Patent [19]

Robinson et al.

[11] Patent Number: 5,918,720

[45] **Date of Patent: *Jul. 6, 1999**

[54] MONEY CONTROL SYSTEM

[75] Inventors: Larry Robinson, Carrollton, Tex.; Mark Robert Peting, Aloha; Jonathan Henry Bosch, Hillsboro, both of Oreg.

[73] Assignee: NKL Corporation, Chesapeake, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,987

[22] Filed: Aug. 20, 1997

Related U.S. Application Data

[63] Continuation of application No. 08/413,361, Mar. 30, 1995, abandoned.

[51] Int. Cl.[6] ..... G07F 7/04

[52] U.S. Cl. ..... 194/206; 235/379

[58] Field of Search ..... 194/202, 206, 194/207; 235/379; 902/1, 12

[56] References Cited

U.S. PATENT DOCUMENTS 5,000,322 3/1991 Goi ..... 209/534
5,140,317 8/1992 Hyatt et al. ..... 235/382 X
5,183,142 2/1993 Latchinian et al. ..... 194/206
5,468,941 11/1995 Sasaki ..... 209/534 X

OTHER PUBLICATIONS

Allied Gary product literature, 1990.
Allied Gary Autobank IQ Series product literature, 1993.
Insta–Guard product literature.
Anycard Cash System product literature.
McGunn Cash Handler 5 product literature, 1991.
Armor Safe Technologies product literature, 1994.
Row RBA Bill Acceptors product literature.

*Primary Examiner*—F. J. Bartuska
*Attorney, Agent, or Firm*—Strasburger & Price, L.L.P.; Matthew J. Booth

[57] ABSTRACT

A safe providing both permanent and temporary storage of money. The safe uses bill validators to accurately count cash deposited into a secure area. A control system records the amount of money entered into both the temporary and permanent storage and the amount withdrawn from the temporary storage. The control system includes both a primary and an auxiliary memory for storing an audit trail of these transactions. Further, the control system utilizes an encryption code for communications between a main controller and each of the door controllers.

4 Claims, 15 Drawing Sheets

600

602

XOPERATOR GROUP REPORT
OPERATOR 04 REPORT
VEND $27.00
LOAD $50.00
UNLOAD $175.00
DROPS VALIDATED;
$1.00 - $126.00
$2.00 - $4.00
$5.00 - $245.00
$10.00 - $560.00
$20.00 - $2040.00
$50.00 - $100.00
$100.00 - $300.00
TOTAL - $3375.00
DROPS MANUAL;
$456.32
TOTAL DROPS - $3831.32

CASH WITHDRAWALS $4578.93

OF DOOR OPENS 2
OF ARMORED CAR OPENS 1

8B

FIG. 8A

8A

604

OPERATOR 07 REPORT
VEND $17.00
LOAD $40.00
UNLOAD $165.00
DROPS VALIDATED;
$1.00 - $26.00
$2.00 - $0.00
$5.00 - $140.00
$10.00 - $210.00
$20.00 - $1020.00
$50.00 - $0.00
$100.00 - $100.00
TOTAL - $1496.00
DROPS MANUAL;
$118.12
TOTAL DROPS - $1614.12

CASH WITHDRAWALS $0.00

OF DOOR OPENS 0
OF ARMORED CAR OPENS 0

TRANSACTION #781 OPERATOR 04
TIME 07:32:00 DATE 05/24/94

606 608

FIG. 8B

700

702

ZOPERATOR GROUP REPORT
OPERATOR 04 REPORT
VEND $27.00
LOAD $50.00
UNLOAD $175.00
DROPS VALIDATED;
$1.00 - $126.00
$2.00 - $4.00
$5.00 - $245.00
$10.00 - $560.00
$20.00 - $2040.00
$50.00 - $100.00
$100.00 - $300.00
TOTAL - $3375.00
DROPS MANUAL;
$456.32
TOTAL DROPS - $3831.32

CASH WITHDRAWALS $4578.93

OF DOOR OPENS 2
OF ARMORED CAR OPENS 1

9B

FIG. 9A

9A

704

OPERATOR 07 REPORT
VEND $17.00
LOAD $40.00
UNLOAD $165.00
DROPS VALIDATED;
$1.00 - $26.00
$2.00 - $0.00
$5.00 - $140.00
$10.00 - $210.00
$20.00 - $1020.00
$50.00 - $0.00
$100.00 - $100.00
TOTAL - $1496.00
DROPS MANUAL;
$118.12
TOTAL DROPS - $1614.12

CASH WITHDRAWALS $0.00

OF DOOR OPENS 0
OF ARMORED CAR OPENS 0

TRANSACTION #781 OPERATOR 04
TIME 07:32:00 DATE 05/24/94

706 708

FIG. 9B

800

AUTO BANK CASH REPORT

802
COLUMN #01 07 TUBES $3.50
COLUMN #02 09 TUBES $18.00
COLUMN #03 06 TUBES $30.00
COLUMN #04 07 TUBES $70.00
COLUMN #05 09 TUBES $180.00
COLUMN #06 09 TUBES $180.00
COLUMN #07 04 TUBES $80.00
COLUMN #08 04 TUBES $80.00
COLUMN #09 00 TUBES DISABLED
COLUMN #10 00 TUBES DISABLED
TOTAL LEFT VEND CHAMBER $641.50

804
CASH IN VALIDATOR
VALIDATOR 01 $456
VALIDATOR 02 $245
VALIDATOR 03 $510
VALIDATOR 04 $4260
VALIDATOR 05 $158
TOTAL VALIDATOR $5638

806
MANUAL DROPS
$234.67

808
TOTAL CASH IN AUTOBANK $6514.17

TRANSACTION #0162 OPERATOR 01
TIME 05:06:51 DATE 05/24/94

810 812

FIG. 10

902

| Display | Action |
|---|---|
| "VEND DELAY 00:00" | Press the Report Button. |
| "ENTER PIN NUMBER" | Enter a PIN with Access to Run Reports. |
| "ENTER REPORT NUMBER" | Enter 57 and press enter. |
| "START TIME 00:00" | Enter the beginning time you need to see activity. |
| "START DATE 05/23/94" | Enter the beginning date for the activity report. |
| "END TIME 05/23/94" | Enter the ending time for the activity report. |
| "END DATE 05/23/94" | Enter the ending date for the report. |
| "BEGINNING CASH IN AUTOBANK" | Enter the TOTAL CASH IN AUTOBANK from the previous Autobank Cash Report. |
| "WHICH ACTIVITY -00-ALL" | Enter the Activity Code to search for. 00 for all Activity Codes. |
| "WHICH OPERATOR -00- ALL" | Enter the code for the Operators to search for. 00 for all Operators. |

FIG. 11A

900

AUTOBANK ACTIVITY REPORT
ACTIVITY CODES (AC)

904

01 VEND
02 LOAD
03 VALIDATED DROP
04 DROP VALIDATOR OVERRIDE
05 MANUAL DROP
06 OPEN DOOR
07 ARMORED CAR OPENED DOOR
08 UNLOAD
09 EJECTOR JAM
10 PROGRAMMER LOGGED IN
11 CASH WITHDRAWAL

906

AC01 OPR5 07:32 05/23/94 CLM1 $0.50
AC03 OPR4 07:34 05/23/94 VDRP
1.00 - $32.00
10.00 - $40.00
TOTAL $72.00
AC06 OPR2 07:37 05/23/94 DOOR 2
AC11 OPR2 07:37 05/23/94 $456.32
AC10 PROGRAMMER 1 07:56 05/23/94
PROGRAM 14
AC07 DOOR 1 08:15 05/23/94
AC11 OPR2 08:15 05/23/94 $5678

11C

FIG. 11B

MONEY CONTROL SYSTEM

This application is a continuation of application Ser. No. 08/413,361 filed Mar. 30, 1995, now abandoned.

TECHNICAL FEILD OF THE INVENTION

The present invention relates to a money control system, and more specifically to an intelligent safe. The safe incorporates numerous security features, bill validators, cash dispensers and a comprehensive audit trail.

BACKGROUND OF THE INVENTION

Safes have been used to store money and other valuables for hundreds of years. In an age of convenience stores, the need for safes has became even more acute. An excess of cash in the cash register is an easy target for a robber or a dishonest employee. Therefore, safes have been developed which allow a clerk to clear excess cash and coin from the cash register and store that money in the safe. However, due to the number of transactions conducted in a convenience store, money must be accessible to some extent. Therefore, safes have been developed with both temporary and permanent storage compartments.

An example of a safe having separate temporary and permanent storage compartments is the AUTOBANK IQ by Allied-Gary International of Waynesboro, Ga. Money placed into a permanent storage compartment cannot be retrieved until an authorized employee arrives with a key, typically once every twenty-four hours. Permanent storage is merely a drop slot which leads to an inner lock box. Money placed into temporary storage must first be placed into reusable plastic tubes. For example, forty quarters can be placed into a tube. This tube is then inserted into a portal uniquely designated for quarters. The clerk instructs the safe that he is going to deposit the money by pressing a "load" key. The safe then prompts the clerk for his employee identification number. The safe then prompts the clerk to load the tube into the appropriate portal. The safe counts the tubes as they are inserted. Once loaded, the tube enters a partitioned storage area. The clerk might then place twenty one dollar bills from the register into another plastic tube and insert it into a second portal which is uniquely designated for one dollar bills. Again, the deposit is entered into a control panel specially designed to accept this data entry. The tube containing the one dollar bills is then stored in a partitioned storage area separate from other denominations of currency. Separate portals are provided for each common denomination of coin and cash. If the cash register later runs short of a particular currency, the clerk can access the money in the temporary storage of the safe. He must enter an appropriate code or command on the control panel along with the amount requested. For instance, if the cash drawer is short on one dollar bills, the clerk can request a tube of one dollar bills. A tube is released from its partitioned space and then dispensed to a tray on the front of the safe. The bills therein are then placed back into the register.

Sophisticated safes such as the Autobank IQ provide a balance between security and audit capabilities. During a robbery, the cash in the register is the easiest target. If the robber is willing to wait, he can compel the clerk to dispense money from the temporary storage of the safe. However, as an added precaution, this money can only be dispensed at a specific or controlled rate. For example, a withdrawal might be allowed every two minutes. The rate at which money can be dispensed can be varied according to the time of day. A thief at night is usually unwilling to risk waiting for more than one withdrawal from the temporary storage. However, in the middle of the day, a clerk might need access at a quicker rate.

A dishonest employee is deterred from pocketing cash from the register because the safe incorporates a program which tallies the deposits and withdrawals. At the end of a reporting period, such as a day or an eight hour shift, a record of the amount of money deposited into the temporary and permanent storage compartments is retrieved. The record is a simple audit trail of the entries made to the control panel. This amount can then be compared to the cash register's record of sales for the same reporting. Balancing these amounts often takes too much valuable managerial time.

The Autobank IQ and similar safes have several drawbacks. First, it is difficult to accurately audit money that is deposited into a permanent storage. The clerk making the deposit should enter the correct amount. However, if he pockets a portion of the deposit, an auditor reviewing the audit trail after three eight-hour shifts can not determine which shift committed the theft. Secondly, the safe cannot identify counterfeit money used for a purchase. Last, if a supervisor with a key to the safe wants to steal money, he can open the safe, withdraw the money, and then damage the electronic memory device which contained the audit information, including his identification number, as the employee who last opened the safe.

Therefore, a need exists for an intelligent safe which provides a more complete audit trail. Such a safe should provide a way to validate the authenticity, denomination and number of bills being inserted into permanent storage. The safe should also include an auxiliary memory device which is hidden from the clerk's view.

SUMMARY OF THE INVENTION

The present invention is a money control system which provides advantages in the areas of security, accuracy, and audit trail capabilities. As discussed above, "internal shrinkage" of funds is a serious problem in cash handling industries. For example, money control systems are especially useful in convenience stores, hotels, fast food restaurants, grocery stores, and mass merchandisers. A dishonest employee can clear the till to fill his own pockets. Honest employees can incorrectly count the amount deposited. In either case, the time required to reconcile the safe's audit report with the amount of money on hand is time consuming. Therefore, the present invention uses at least one bill validator to count the money deposited into the permanent storage compartment. The validator is capable of distinguishing between various denominations of bills as well as culling any counterfeit bills passed by a customer. In one embodiment, several validators are used, each geared to accept a unique denomination of bill. After validation, the bills can be sorted by the validator into different stacks within the permanent storage area. By sorting the bills, managerial time is conserved.

A further improvement involves the use of an auxiliary memory in a hidden, innocuous location within the safe. This will protect the store owner from an employee who would steal money from the safe and then damage the memory associated with the audit functions. The auxiliary memory maintains a second record of employee access numbers used to enter the safe.

Another improvement involves the communication between the main controller and the door controllers. With electronic safes, the door controller opens a safe door when it receives the appropriate signal from the main controller. Yet, the communication line between the main controller and the door controller is not always a secure line. A sophisticated thief can tap into this cable and intercept the signal used to open the safe door. To combat this threat, the door controller and the main controller can each contain an encryption code. The door controller will first generate a random number and then send that number to the main controller. The main controller will encrypt this random number. The encrypted number is then sent back to the door controller which can decode it. If the unencrypted number matches the original random number, the door controller will accept the open command. By using a random number the returned encrypted number will differ with every use. Thus, even if a thief intercepts the encrypted command, he cannot use it to open the safe at a later time or to open a similar model of safe.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIGS. 5 through 11 are various audit reports generated by the electronic control system.

DETAILED DESCRIPTION OF THE INVENTION

Figure 1:
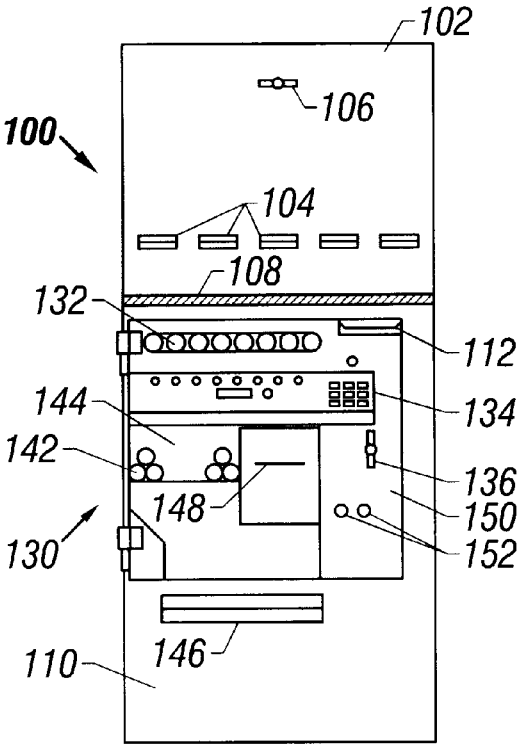
FIG. 1 is a front view of the safe.
Figure 2:
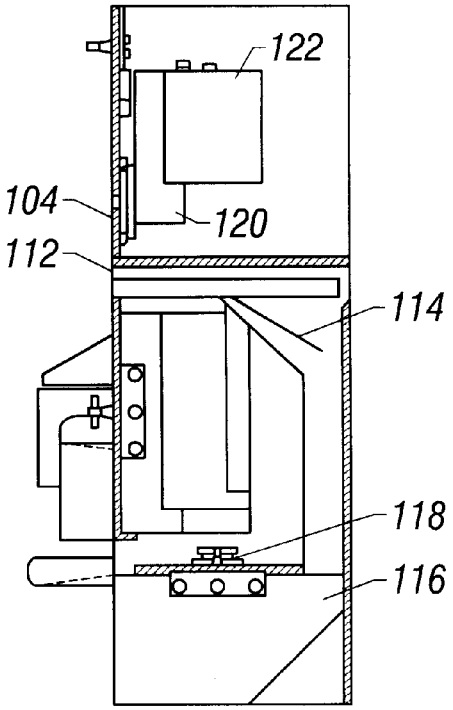
FIG. 2 is a side sectional view of the safe.
Figure 3:
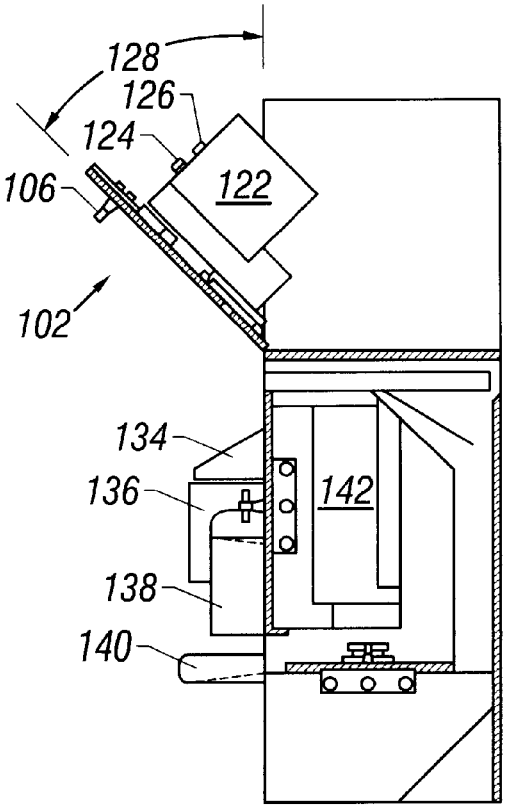
FIG. 3 is a side view of the safe wherein the permanent storage compartment is opened.

The present system is a money control system and specifically an intelligent safe which overcomes many of the disadvantages found in the prior art. FIGS. 1 to 3 provide various views of the exterior of the safe 100. As would be expected, the safe itself is ruggedly constructed to deter penetration. The walls and doors can be constructed of an appropriate material such as hardened steel. In one embodiment, the safe weighs approximately seven hundred pounds. Further, the safe can be bolted to the floor to prevent its theft.

In one embodiment, the safe 100 has a first permanent storage compartment 102 which accepts bills through at least one validator 104. The illustrated configuration utilizes five validators, each geared to accept different denominations of bills, i.e. one, five, ten, twenty, and fifty. A suitable validator is the RBA bill acceptor from Rowe International, Inc. of Rockwall, Tex. The money inserted into the validator is conveyed via mechanism 120 into partitioned compartments 122. By having multiple validators geared to different denominations, money is automatically sorted. If the clerk accidently places a ten dollar bill into the five dollar bill validator, the bill is kicked back to the clerk. The clerk should then reinsert the bill into the correct validator. Each validator has its own path to its own compartment. By automatically sorting the money, managerial time is saved.

The permanent storage compartment 102 is considered permanent because it does not allow for casual access by an employee. However, as will be discussed in more detail below, an authorized employee or armored car service can access the permanent storage with the appropriate code and key. Once the locking mechanism is released, the latch 106 is used to open the door as shown. The door rotates about hinges 108 to angle 128. Once opened, the partitioned compartments 122 containing the sorted cash be accessed through doors or trays 124, 126. The partitioned compartments 122 are tamper resistant and completely sealed. The partitioned compartments 122 can be uniquely identified for armored car logging purposes. Once the permanent storage compartment 102 is emptied, the door 107 is closed and automatically relocks. The door 107 can also be hinged on the side.

If power is disrupted, the validators will not operate. Therefore, a second permanent compartment 116 is provided. Money can be deposited into slot 112. The money slides down ramp 114 and falls into compartment 116. When the money is to be retrieved, a front door 150 is opened with latch 136, revealing yet another locking mechanism 118. Once this is opened, the money in compartment 116 can be retrieved. Unlike the first permanent storage compartment, money deposited via slot 112 is unsorted.

If the safe's control system fails, the front door 150 can be opened by simultaneously turning keys in the locks 152. Power to the safe must come from an external wall mount power supply. A suitable power supply should provide a sixteen volt (AC), eight amp output to power both the control system as well the validators.

Most businesses prefer to keep an optimum amount of operating funds in the register. However, in the course of doing business, the register will build up an excess of certain coins or denominations. For example, after two hours of peak activity, the register might contain twenty extra dollars of quarters, and three hundred extra dollars of twenty dollar bills. The clerk will want to clear the register to place this money beyond the easy reach of a robber, and also to free up further space in the register. However, rather than place all the money into permanent storage, he might choose to put some into temporary storage 130. This is accomplished by taking a plastic tube 142 from the empty tube compartment 144. A tube 142 is filled with an amount of cash, for example forty quarters. This tube is then placed into one of the plurality of portals 132 designated for quarters. The amount placed into the tube, ten dollars, is entered into the control panel 134. The amount, operator number, and time are recorded in memory for audit purposes. Next, the clerk might take ten of the twenty dollar bills and roll them into another empty tube 142. He would then place that tube into a portal 132 designated for twenty dollar bills. Again, he would record this transaction on the control panel. Last, he might take the remaining five twenty dollar bills and insert those into the validator 104 for that denomination, thus placing them into permanent storage. Again, this transaction would be recorded either manually or automatically. An audit report of the transactions can be printed with printer 148.

Occasionally, the cash register will run low on a particular currency. For example, if the register is out of one dollar bills, it might become difficult to make change for a customer. Therefore, the clerk can retrieve money placed into the temporary storage 130. Assuming that a tube 142 with one dollar bills was deposited earlier, the clerk can enter his request into the control panel 134, and a tube 142 containing one dollar bills will be dropped into tray 146. The clerk will remove the one dollar bills in the tube 142, place them in his register and then replace the empty tube 142 with the others in compartment 144 for reuse. The temporary storage 130 operates best when uniform amounts of currency are placed into the tubes 142. For example, the clerk should always place twenty one dollar bills in a tube 142 and then always deposit that tube 142 into the appropriate portal. Likewise, dimes can be grouped into sets of fifty ($5.00), pennies into groups of fifty ($0.50), and so forth. Tubes 142 can be generic, capable of handling any size of coin or currency. Alternatively, unique tubes can be dimensioned for each size of coin.

Figure 4A:
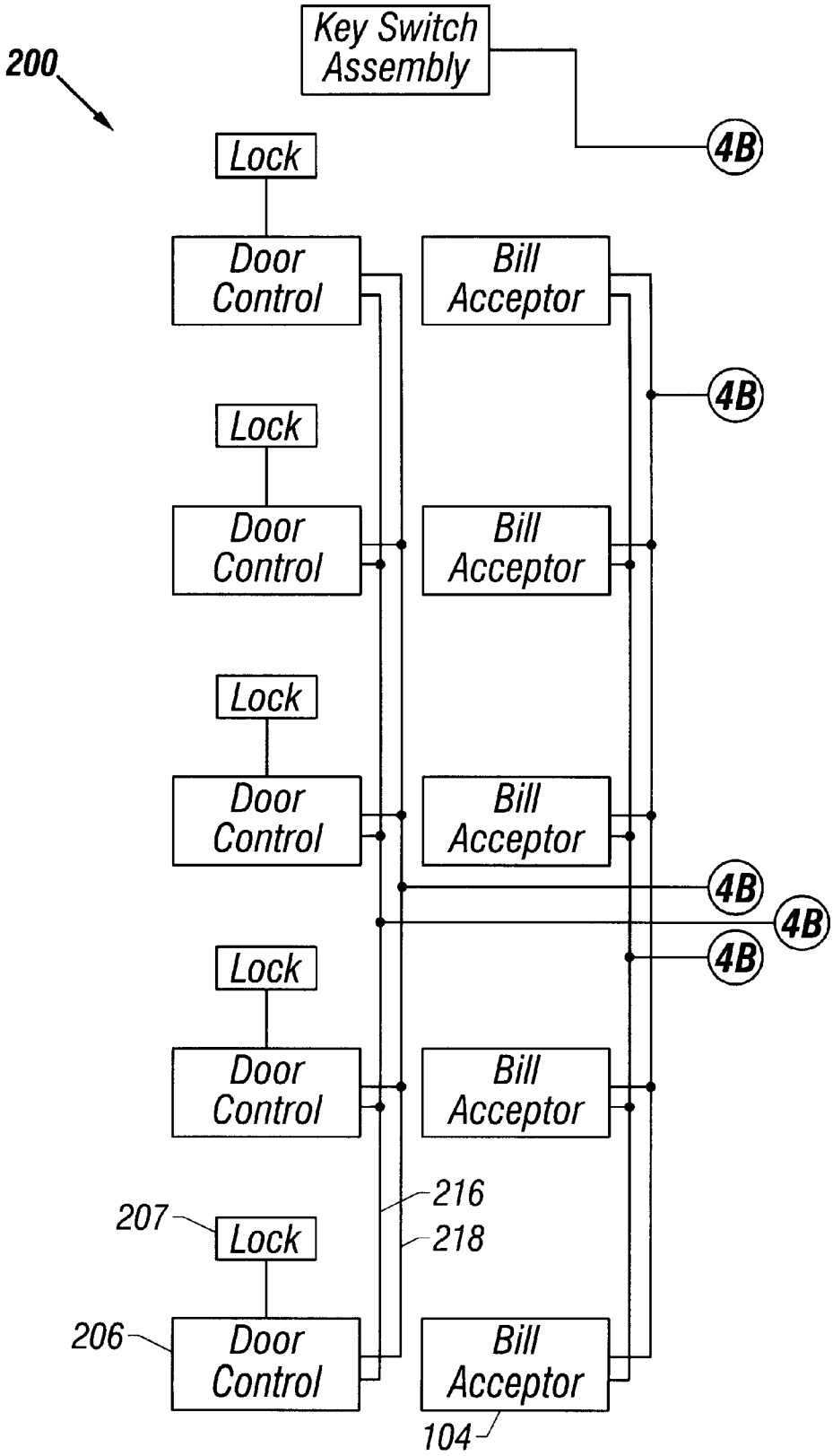
FIG. 4 is a block diagram of the electronic control and audit system for the safe.
Figure 4B:
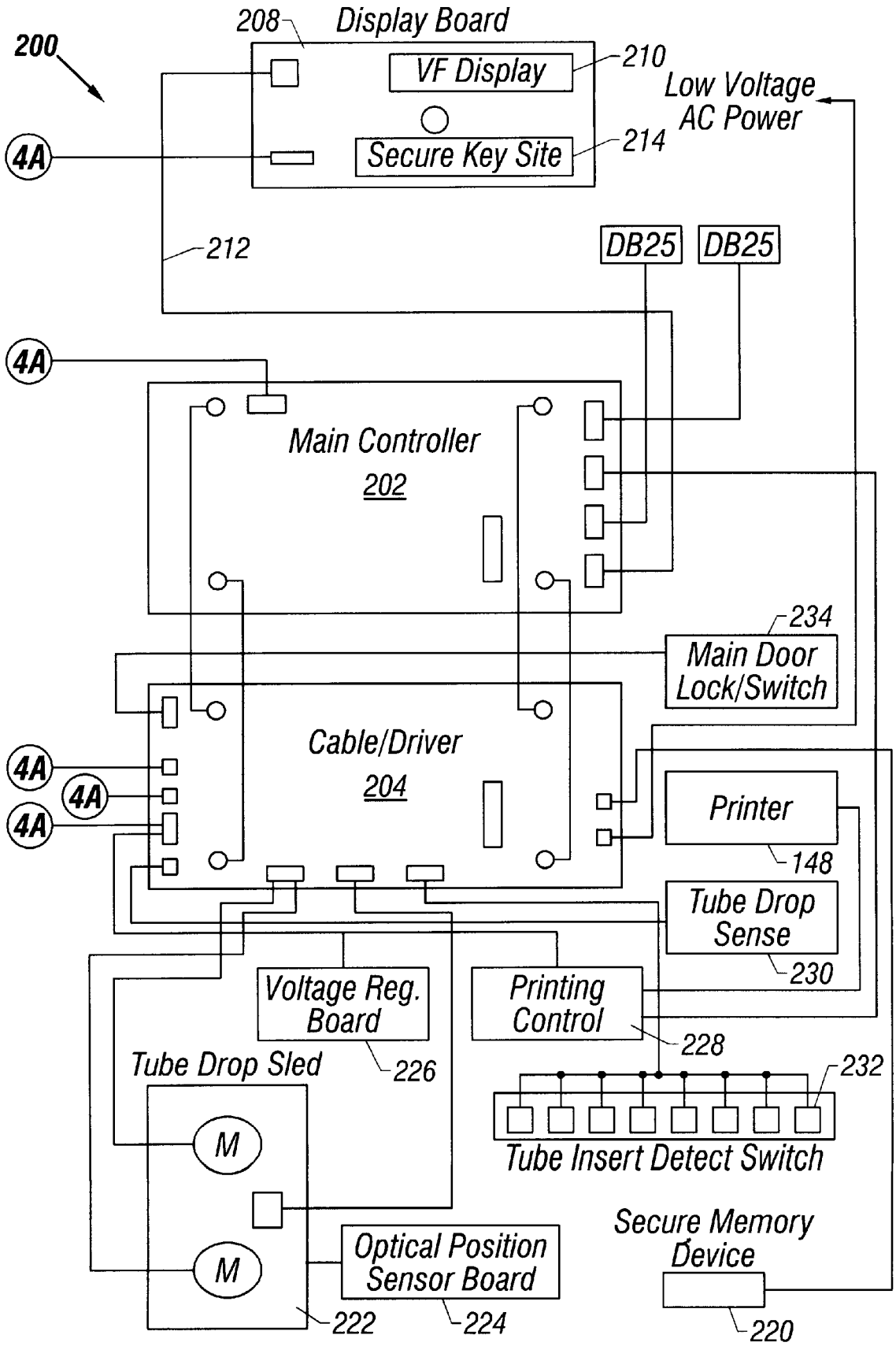

As mentioned above, the safe's electronic control system monitors all transactions with the safe. The control system 200, shown in FIG. 4, also contains programming to produce audit reports based upon the entries made to the control panel. The control system 200 also provides added security features by controlling the locking mechanisms to the various doors to the safe. The control system 200 includes a number of components. The main controller 202 provides the majority of the system's intelligence and holds the main transaction log and all of the configuration information. The main controller also controls the display, printed data, remote communication, keyboard input, and the like. In one embodiment, the main controller uses a printed circuit board containing a Intel brand 16-bit 80188, 8 MHz microprocessor. The controller 202 can also incorporate a 32 Kbyte SRAM scratchpad memory and one Mbyte flash file memory for source code and log entries. In one embodiment, the controller 202 supports five door lock solenoids and over thirty bill validators 104.

The cable/driver board 204 provides the mounting point for the main controller 202 and also holds power supply components, motor drivers, and input signal conditioning. It also interfaces to the door controllers 206. The display board 208 holds the high voltage power supply and drivers for the vacuum fluorescent display 210. Display board 208 is serially fed pixel data at a high rate via line 212 by the main controller 202. It also scans the safe keyboard and returns, via, a serial protocol, information about which keys are pressed. It also has a site for a secure key 214 which can be used for user authentication. A secure key utilizes a physical key coupled with an electronic circuit including a readable memory. The circuit is physically located onto the key. When the key is inserted into a lock on the safe, a second circuit reads the information stored on the key. This information could include access information and a password known only to the authorized holder of the key. For example, an armored car service driver could have a key which authorizes full access to every compartment in the safe upon the entry of the correct password. Thus, even if an employee looks over the armored car driver's shoulder and sees his password, the employee could not use that password to access a restricted part of the safe. Likewise, if an employee's key is stolen, it will not access the safe without the entry of the employee's password.

An additional security feature is provided by the door controllers 206. A door controller 206 is associated with the locking mechanism on each door. Each door controller contains a microprocessor storing an encryption code and having the ability to generate a random number. The main controller also contains the same encryption code. Each door controller first generates a random number which is sent to the main controller. The main controller then encrypts that number using the encryption code. When the main controller wants to send a signal to a particular door, the encoded number is first sent to the door controller. The door controller uses the same encryption code to see if the number matches the random number originally sent to the main controller. If it matches, the door controller will accept the signal to open the particular door. After each opening, the door controller generates another random number and the process is repeated. This method prevents the inner doors from being opened by manipulating the cables in the compartment. For example, a sophisticated thief might tap into the cable between the door controller and the main controller to intercept and record the signal sent to open a door. However, in that event, the recorded signal cannot be used to reopen a particular door because the random number will be different every time. Without the deeply embedded encryption code, the thief would be unable to recreate an appropriate signal by merely feeding in random numbers. The main controller 202 will only perform the encryption if it is already trying to open the door, but not at other times. This door controller 206 also returns the status of switches 216 to indicate whether the door has been closed. There are two cables 216, 218 to the door controllers 206, either one of which is sufficient to operate them. If one of the cables fails, this information will be signalled to the main controller by the door controllers so that repair can be performed before the other has a chance to fail. This prevents a single cable failure from making the safe impossible to open.

A secure memory device is also coupled to the main controller 202. The secure memory device 220 contains the real time clock for the main controller. It also has a small, secure memory that holds as many log entries as space allows. It is located within the most secure compartment in the safe. The memory device 220 insures that a record of the door opening is retained even if an employee invades the safe, robs it and then destroys the main controller 202 where transactions are normally stored.

The validators 104 are run from an RS485 serial port on the main controller. Each can accept and store currency under control of software in the main controller. The tube drop sled 222 is incorporated into the temporary storage department. This device has motors which move the sled to a desired tube column and then facilitate pushing a tube into a drop area 140. It also has optical sensors 224 to verify its position. The motors are driven by power drivers on the cable/driver board 204.

Other aspects of the control system 200 include a voltage regulator board 226 which takes unregulated +16 volts from the cable/driver board, and returns regulated +5 volts for the main controller 202, display, and printer 148. It also produces regulated +12 volts for the bill acceptors and the printer. The printer controller 228 takes RS232 serial character data from the main controller 202, and generates output on the printer 148. A tube drop sensor 230 is a high power LED and photo transistor set which send a beam across the area where tubes drop. An interruption of this beam indicates that tube 142 has been successfully released. The interruption is sensed by circuits on the cable/driver board 204. A tube insert detect switch 232 is associated with each portal 132 and sends a detect signal to the main controller when a tube is loaded into the safe. A main door lock/switch 234 is a solenoid lock used to open the main door. The door can be opened under program control, often after one of the keys is operated. There is also an override function which allows the door to be opened, by turning keys 152 simultaneously, if the logic of the main controller fails.

Figure 5:
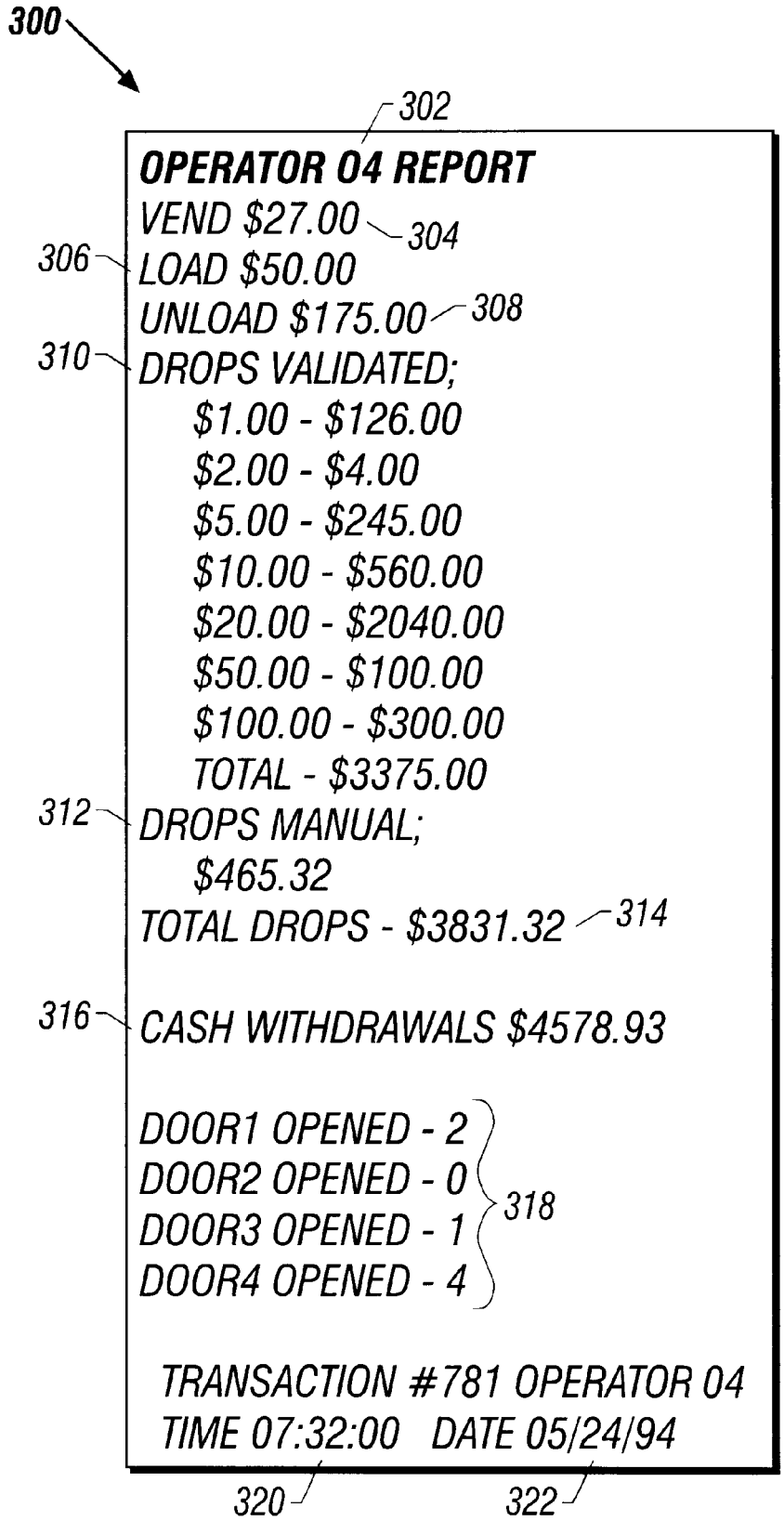

As alluded to above, unique software is loaded into the main controller 202. The software monitors internal functions of the safe, and also can generate reports based upon the data entered by the clerk making a deposit or withdrawal. The software can be modified without removing any boards or hardware. Various reports can be generated based upon the needs of the auditor. FIGS. 5 to 11 are a sampling of these reports. FIG. 5 is an operator's report 300, a report that a sales clerk would receive at the end of his or her shift. The report recaps the Operator's activity since the last "Z-Operator Group Report", discussed below. The operator's report 300 indicates the specific employee 302. It also includes the vend 304, load 306, and unload 308 amounts. The report also lists the drops 310 through the validators on a per denomination basis. The report next lists the manual drops 312 and then adds these amounts to create a total drop value 314. The operator report also lists the cash withdrawals 316 made from the safe. Additionally, a count 316 of which doors in the safe were opened is included. Finally, the report includes the time 320 and the date 322 on which the report was run.

Figure 6:
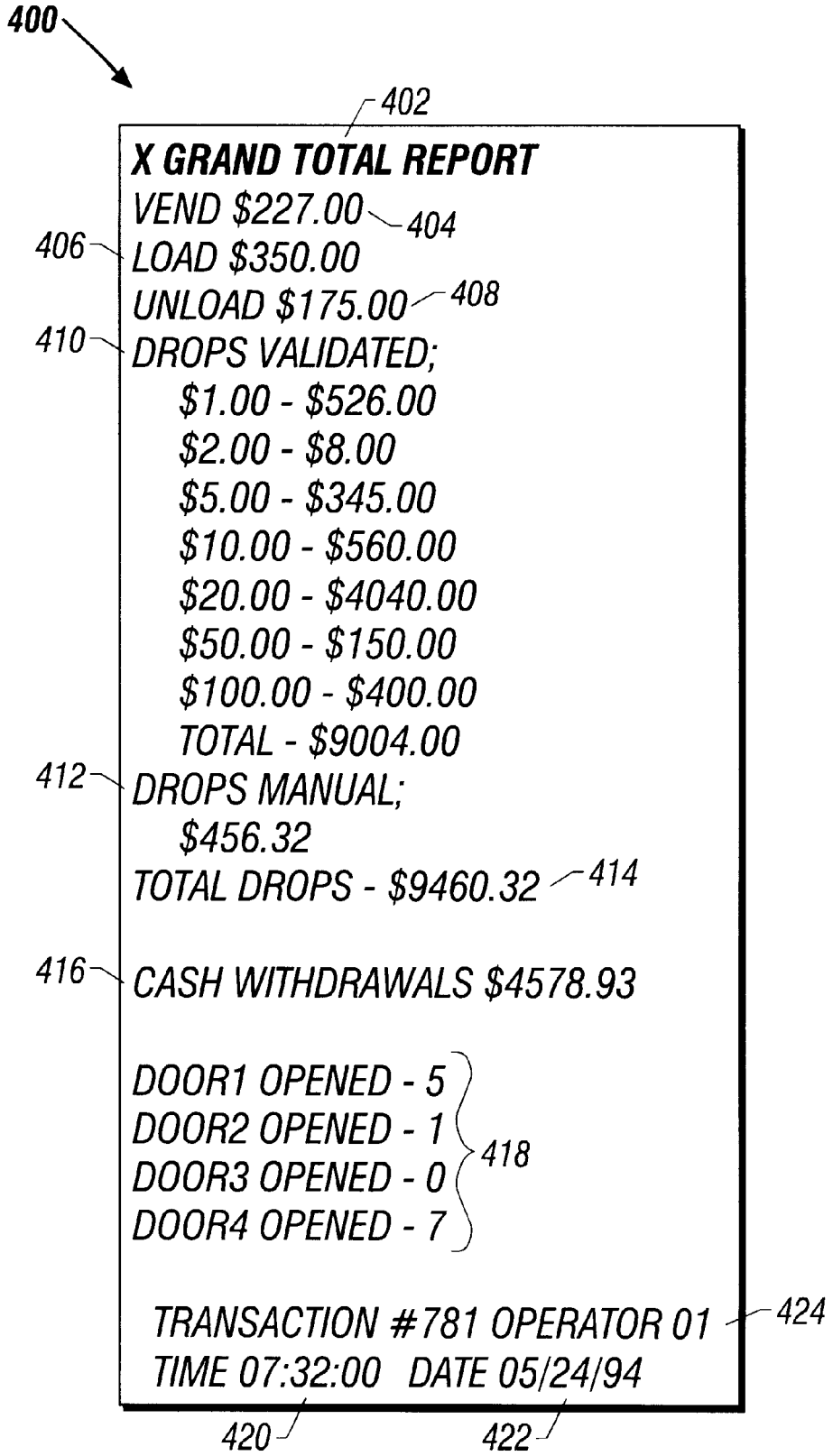
Figure 7:
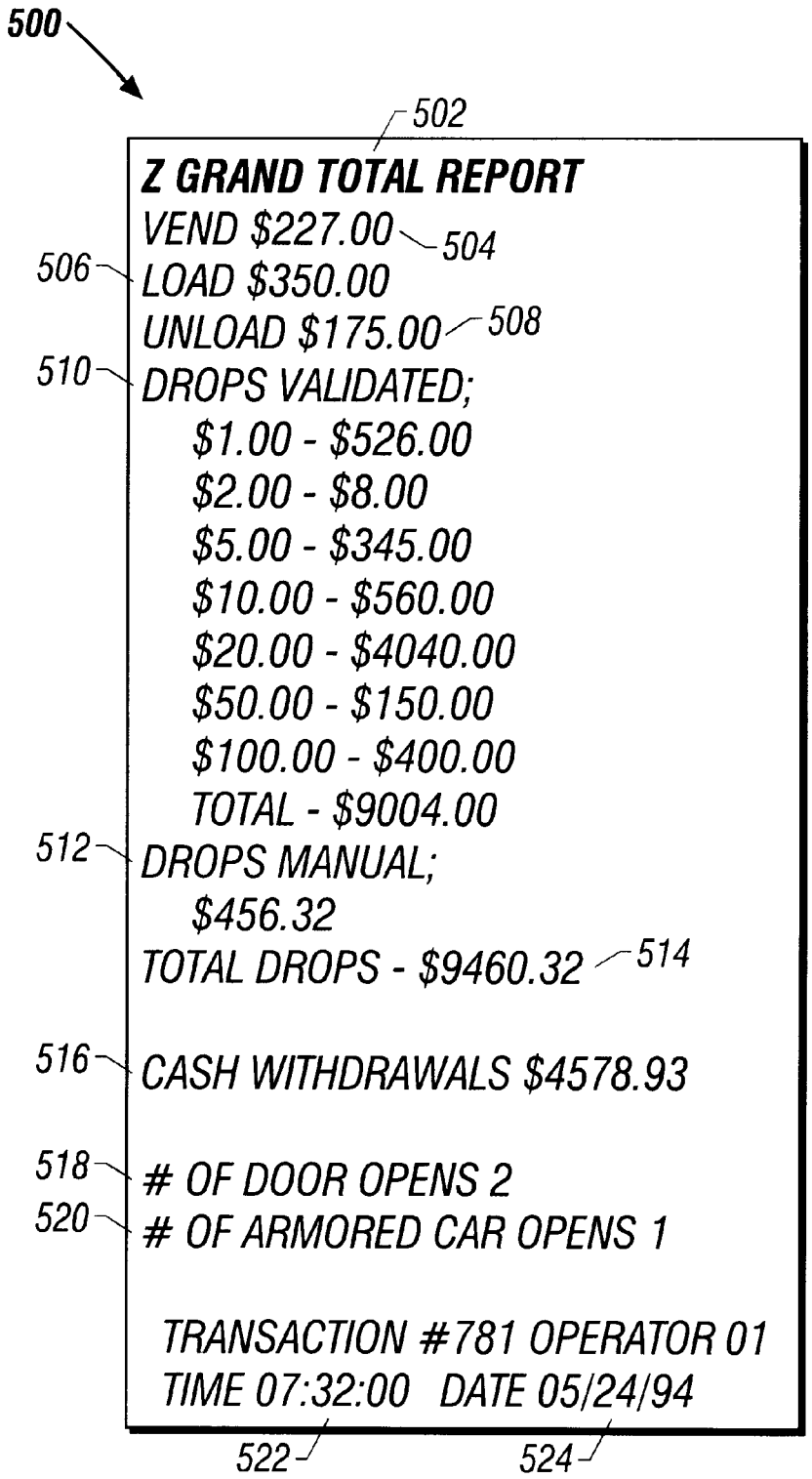

FIG. 6 is an example of an "X Grand Total Report" 400 which is a combined report of all activity of all operators. It includes a title line 402 and is similar in format and content to the operator's report 300. The operator who ran the report is shown at 424. FIG. 7 provides an illustration of the "Z Grand Total Report" 500 which is similar to the X Grand Total Report 400 except that it includes a total 518 of times the doors in the safe were opened as well as the number of armored car opens 520. Again, both the time 522 and date 524 that the report is printed. FIGS. 8 and 9 are examples of the "X-Operator Group Report" 600 and "Z-Operator Group Report" 700. Both include an operator's report for all operators that have had activity since the last Z-Operator's Group Report. Report 600, shown in FIG. 8, includes a report 602 for operator 4 and a report 604 for operator 7. The report also includes the time 606 and time 608 that the report was printed. The "Z-Operator Group Report" in FIG. 9 is similar in format and content to the "X-Operator Group Report." The difference between an X-report and a Z-report is that the Z-report zeroes the totals while the X-report does not.

Figure 11C:
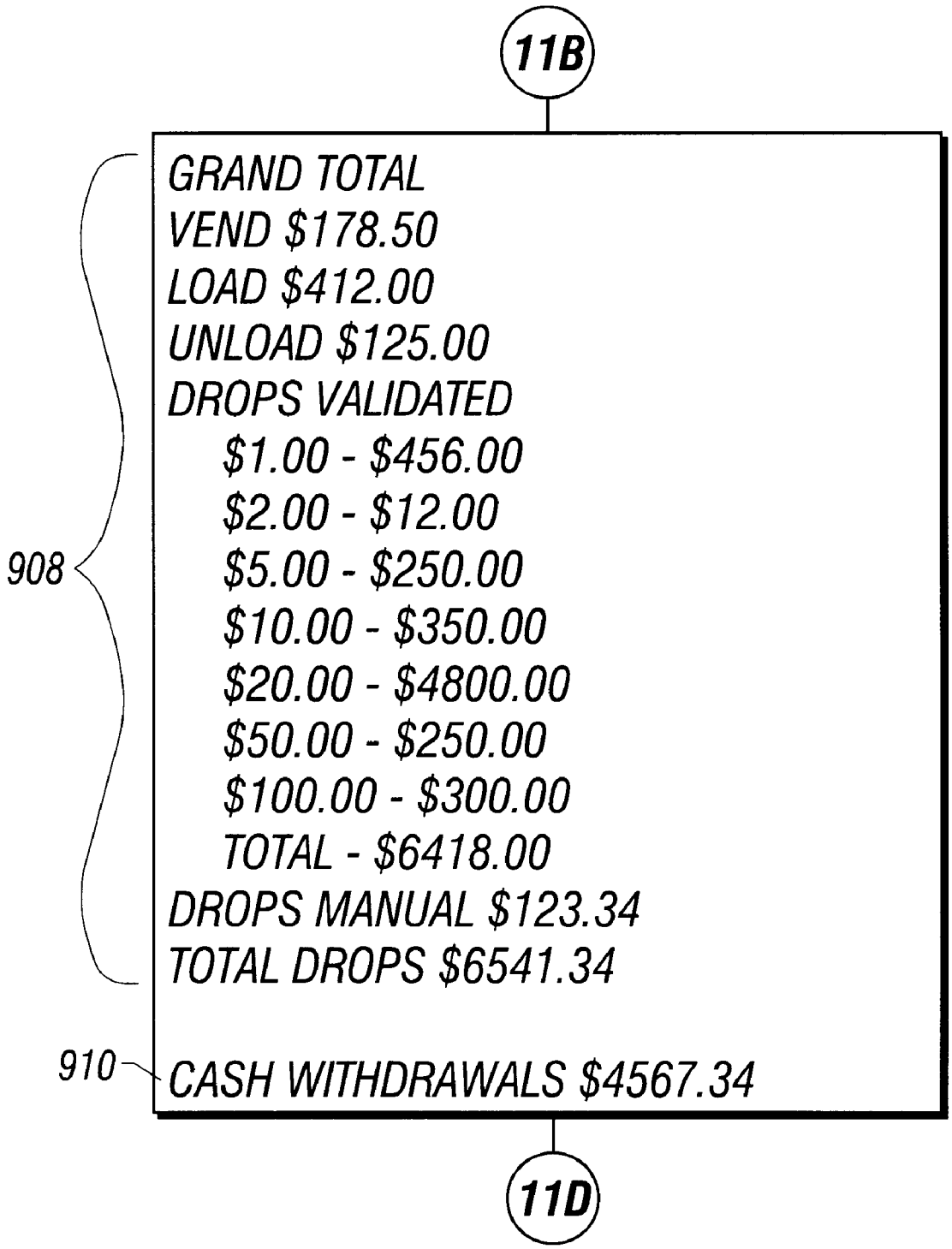
Figure 11D:
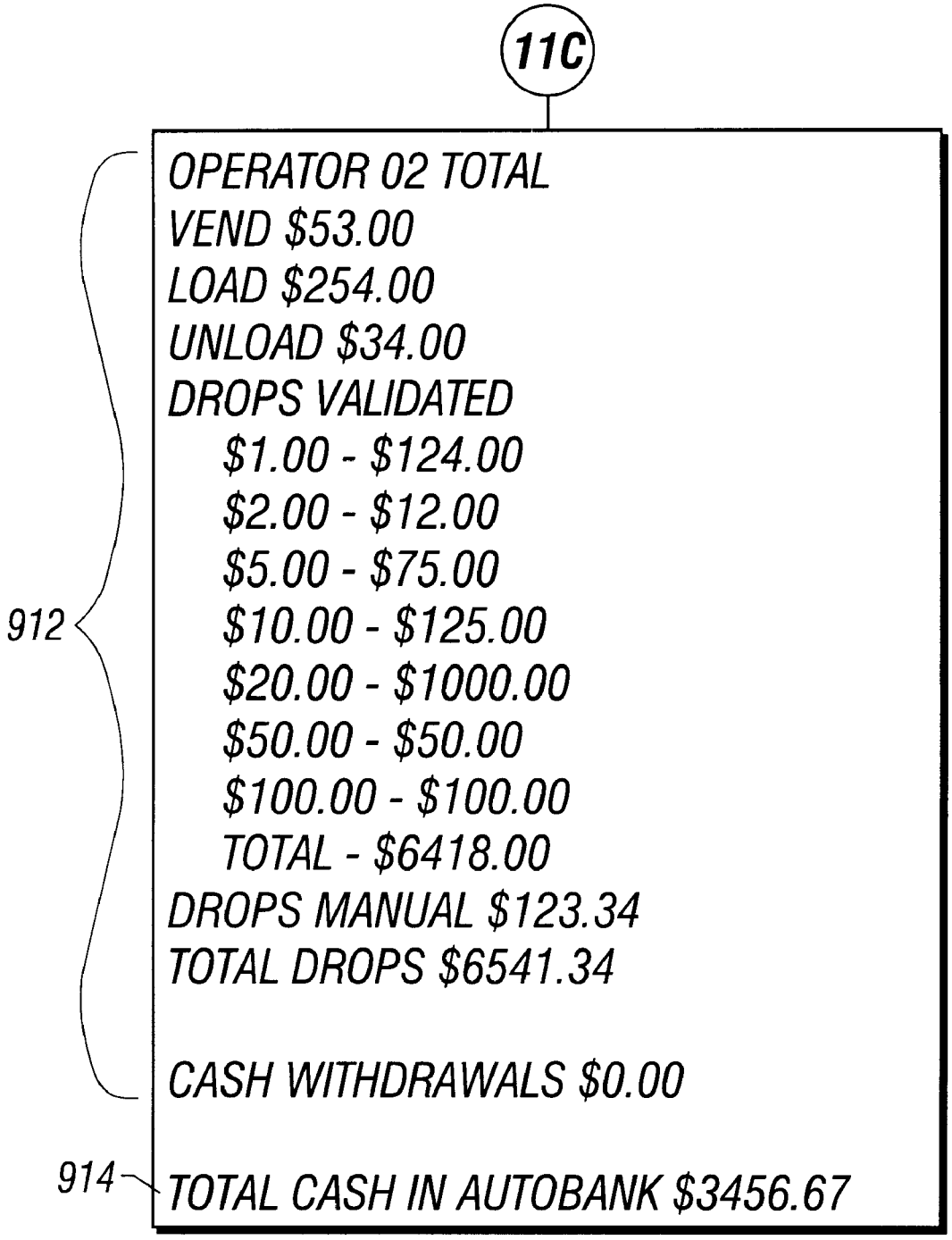

FIGS. 10 and 11 illustrate particularly useful reports for the store owner. FIG. 10 is a Cash Report 800 which recaps the total amount of cash in the safe. This report lists the cash in the vend chamber 802, the currency validators 804, and the manual drops 806. A total 808 is also provided as well as the time 810 and date 812 of the report. FIG. 11 is an Activity Report 900 which prints all the activity during a certain period. A series of prompts 902 are displayed to the auditor. When answered as indicated, the report will summarize all activity within that reporting period.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the appended claims.

We claim:

1. A money control apparatus that securely receives and dispenses paper and coin money, comprising:

one or more tubes;

an enclosed frame containing a temporary storage compartment, a first permanent storage compartment, and a second permanent storage compartment, wherein said first permanent storage compartment is accessible by a first lockable door and said second permanent storage compartment is accessible by a second lockable door;

an electronic control system comprising a main controller, a secure memory device, at least one door controller, and at least two redundant cables coupled between said main controller and said door controller, wherein said main controller stores an encryption code, wherein said door controller stores a decryption code and a random number generator, wherein said main controller and said door controller are both contained within said enclosed frame, and wherein said electronic control system will not allow said first lockable door or said second lockable door to be opened unless the value of a number encrypted by said main controller and decrypted by said door controller equals the value of a random number generated by said door controller;

wherein said first permanent storage compartment comprises two or more permanent storage openings and is configured to accept money through said two or more permanent storage openings, but is not configured to disburse money through said two or more permanent storage openings, said first permanent storage compartment further comprises:

two or more bill validators, each coupled to a distinct one of said permanent storage openings, wherein each said validator is configured to accept a different denomination of paper currency, and two or more partitioned compartments, wherein each of said partitioned compartments is coupled to a distinct one of said bill validators;

wherein said second permanent storage compartment comprises a slot that accepts paper or coin money, a ramp coupled to said slot, and a non-sorting storage compartment that is coupled to said ramp; and wherein said temporary storage compartment is configured to both receive and disburse paper and coin money, wherein said temporary storage compartment further comprises:

a tube compartment that stores said tubes, one or more portals configured to accept said one or more tubes, a tube drop sled that pushes said tubes, and a tray that receives said tubes.

2. A money control system for securely receiving and dispensing paper and coin money, comprising:

one or more tubes;

an enclosed frame containing a temporary storage compartment, a first permanent storage compartment, and a second permanent storage compartment, wherein said first permanent storage compartment is accessible by a first lockable door and said second permanent storage compartment is accessible by a second lockable door;

an electronic control means for preventing said first lockable door and said second lockable door from opening, said electronic control means further comprising a main controller means for encrypting a random number and sending said encrypted random number to a door controller means, a redundant cable means for providing fault-tolerant communications between said main controller means and said door controller means within said enclosed frame, wherein said door controller means further comprises a means for generating a random number, decrypting said encrypted random number to generate a decrypted number, comparing the value of said random number with said decrypted number, and accepting a control signal from said main controller means when the values of said random number and said decrypted numbers are equal;

a first permanent storage receiving means, coupled to said first permanent storage compartment, for receiving, validating, and sorting, but not dispersing, money;

a second permanent storage means for receiving money, but not for validating, dispersing, or sorting, money; and a temporary storage means for receiving and disbursing said tubes.

3. A method to securely receive and dispense paper and coin money, comprising:

placing money to be received into one of a plurality of receiving compartments, wherein said plurality of receiving compartments comprises a temporary storage compartment, a first permanent storage compartment, and a second permanent storage compartment, wherein said first permanent storage compartment is accessible by a first lockable door and said second permanent storage compartment is accessible by a second lockable door;

receiving disbursed money from said temporary storage compartment;

removing money from said first or second permanent storage compartment only when a security process has completed;

wherein said security process is performed by an electronic control system comprising a main controller, a door controller, and at least two redundant cables coupled between said main controller and said door controller, wherein the steps of said security process comprise:

generation of a random number by said door controller, transmission, over one of said redundant cables, of said random number to said main controller from said door controller, encryption of said random number by said main controller to generate an encrypted number, transmission, over one of said redundant cables, of said encrypted number and a control signal from said main controller to said door controller, decryption of said encrypted number by said door controller to generate a decrypted number, comparison by said door controller of said decrypted number and said random number, acceptance by said door controller of said control signal if said decrypted number and said random number are equal;

wherein money to be received into said first permanent storage compartment is placed in a first permanent storage opening that is coupled to a validator;

wherein money to be received into said second permanent storage compartment is placed into a slot formed onto the surface of said second permanent storage compartment, wherein said slot is not coupled to a validator; and wherein money to be received into said temporary storage compartment is placed in a tube and said tube is placed in a portal configured to accept said tube.

4. A method to manufacture a money control apparatus that securely receives and dispenses paper and coin money, comprising:

providing one or more tubes;

providing an enclosed frame containing a temporary storage compartment, a first permanent storage compartment, and a second permanent storage compartment, wherein said first permanent storage compartment is accessible by a first lockable door and said second permanent storage compartment is accessible by a second lockable door;

providing an electronic control system comprising a main controller, a secure memory device, at least one door controller, and at least two redundant cables coupled between said main controller and said door controller, wherein said main controller stores an encryption code, wherein said door controller stores a decryption code and a random number generator, wherein said main controller and said door controller are both contained within said enclosed frame, and wherein said electronic control system will not allow said first lockable door or said second lockable door to be opened unless the value of a number encrypted by said main controller and decrypted by said door controller equals the value of a random number generated by said door controller;

configuring said first permanent storage compartment to comprise two or more permanent storage openings and to accept money through said two or more permanent storage openings, but not configuring said first permanent storage area to disburse money through said two or more permanent storage openings;

configuring said first permanent storage compartment to further comprise:

two or more bill validators wherein each said validator is configured to accept a different denomination of paper currency, and two or more partitioned compartments;

coupling each of said partitioned compartments to a distinct one of said bill validators;

coupling each bill validator to a distinct one of said permanent storage openings;

configuring said second permanent storage compartment to comprises a ramp, a non-sorting storage compartment, and a slot that accepts paper or coin money;

coupling said slot to said ramp;

coupling said ramp to said non-sorting storage compartment; and configuring said temporary storage compartment to both receive and disburse paper and coin money, and to further comprise:

a tube compartment that stores said tubes, one or more portals configured to accept said tubes, a tube drop sled that pushes said tubes, and a tray that receives said tubes.

* * * * *

UNITED STATES PATENT AND TRADEMARK OFFICE

CERTIFICATE OF CORRECTION

PATENT NO : 5,918,720

DATED : 07/06/99

INVENTOR(S) : Robinson et al.

It is certified that error appears in the above-identified patent and that said Letters Patent is hereby corrected as shown below:

Column 6, Line 17, Replace "signalled" with --signaled--.

Signed and Sealed this

Twenty-second Day of February, 2000

*Attest:*

Q. TODD DICKINSON

*Attesting Officer*

*Commissioner of Patents and Trademarks*